US005491058A

United States Patent [19]

Jones et al.

[11] Patent Number: 5,491,058

[45] Date of Patent: Feb. 13, 1996

[54] FILM FOR DUPLICATING SILVER IMAGES IN RADIOGRAPHIC FILMS

[75] Inventors: Ralph W. Jones; Catherine C. Wideman, both of Hilton; Paul W. Twombly, Webster, all of N.Y.

[73] Assignee: Eastman Kodak Company, Rochester, N.Y.

[21] Appl. No.: 495,913

[22] Filed: Jun. 28, 1995

Related U.S. Application Data

[63] Continuation-in-part of Ser. No. 287,983, Aug. 9, 1994.

[51] Int. Cl.[6] ..... G03C 1/485

[52] U.S. Cl. ..... 430/596; 430/411; 430/463; 430/496; 430/517; 430/513; 430/523; 430/567; 430/598; 430/963; 430/966

[58] Field of Search ..... 430/596, 598, 430/567, 966, 523, 513, 517, 961, 963, 411, 463, 496

[56] References Cited

U.S. PATENT DOCUMENTS

| | | | |
|---|---|---|---|
| 3,501,305 | 3/1970 | Illingsworth | 96/108 |
| 3,501,306 | 3/1970 | Illingsworth | 96/101 |
| 3,501,307 | 3/1970 | Illingsworth | 96/101 |
| 3,647,463 | 3/1972 | Taber et al. | 96/68 |
| 4,803,150 | 2/1989 | Dickerson et al. | 430/502 |
| 4,855,221 | 8/1989 | Factor et al. | 430/510 |
| 4,877,721 | 10/1989 | Diehl et al. | 430/522 |
| 4,899,611 | 1/1991 | Anderson et al. | 430/494 |
| 4,900,652 | 2/1990 | Dickerson et al. | 430/502 |
| 4,940,654 | 7/1990 | Diehl et al. | 430/522 |
| 4,997,750 | 3/1991 | Dickerson et al. | 430/509 |
| 5,238,799 | 8/1993 | Usami et al. | 430/522 |
| 5,274,109 | 12/1993 | Texter | 548/365.4 |
| 5,298,381 | 3/1994 | Inoue et al. | 430/517 |

FOREIGN PATENT DOCUMENTS 0456163 11/1991 European Pat. Off. .

*Primary Examiner*—Thorl Chea
*Attorney, Agent, or Firm*—Carl O. Thomas

[57] ABSTRACT

A film is disclosed for duplicating a silver image in a radiographic film. A single monodispersed fogged direct-positive emulsion layer is employed. To extend exposure latitude the emulsion layer contains micro-crystalline particles of a dye that competes with the fogged direct positive grains of the emulsion layer for absorption of exposing radiation and can be decolorized during photographic processing.

13 Claims, No Drawings

FILM FOR DUPLICATING SILVER IMAGES IN RADIOGRAPHIC FILMS

This is a Continuation-In-Part of U.S. patent application Ser. No. 287,983, filed 09 Aug. 1994.

FIELD OF THE INVENTION

The invention relates to radiography. More specifically, the invention relates to films for duplicating silver images in radiographic films.

BACKGROUND OF THE INVENTION

In medical radiography a patient is exposed to X-radiation, and the pattern of X-ray attenuation by the patient is recorded in a radiographic film. When processed, a visible silver image is produced in the radiographic film that can be employed as a diagnostic aid in medical treatment.

Frequently a duplicate of the image captured in the radiographic film is required. The simplest approach for accomplishing this is to expose a directpositive radiographic film through the silver image in the original (a.k.a., taking) film. Since the silver image in the taking film is almost invariably a negative image, the duplicating film produces a second negative image.

Although there are two commonly used types of direct-positive silver halide emulsions, (1) the internal image desensitization type and (2) the surface fogged type, only the latter type is compatible with the photographic processing solutions used for radiographic taking films, and hence the latter is the emulsion type of choice for radiographic duplicating films.

Historically a fundamental difficulty in attempting to use surface fogged silver halide emulsions to construct radiographic duplicating films has been that a single emulsion cannot satisfy exposure latitude requirements. The exposure latitude requirement of the duplicating film arises in the following manner. To produce a duplicate of the original or taking film image, it is necessary that the duplicating film exhibit an average contrast of approximately −1.0, duplicating film average contrasts having absolute values (i.e., ignoring the sign) of less than |1.0| will decrease the average contrast of the duplicated image and duplicating film average contrasts of absolute values greater than |1.0| (again, ignoring the sign) will increase the average contrast of the duplicated image. Average contrast is the quotient of the following relationship:

$$\gamma_{av.}=\Delta D \div \Delta \log E$$

where $\gamma_{av.}$=average contrast;

ΔD=the change in optical density; and

Δlog E=the change in exposure, E being measured in lux-seconds.

Notice that when density decreases with increasing exposure ΔD is a negative number and $\gamma_{av.}$ is also a negative number. The contrasts of negative-working films are positive values while the contrasts of direct-positive films are negative values. In both negative-working and positive-working films the higher the absolute value of contrast (ignoring the sign) the higher the contrast. Since radiographic taking films typically have image densities ranging from >3.0 to 0, ΔD in a duplicating film must at least approach −3.0. For average contrast, $\gamma_{av.}$, to be approximately −1.0, exposure latitude, Δlog E, must also be approximately 3.0.

There is no single surface fogged direct-positive emulsion that exhibits an exposure latitude of 3.0 log E. As taught by Illingsworth U.S. Pat. Nos. 3,501,305, '306 and '307, the most efficient direct-positive emulsions are those produced by surface fogging silver halide grains that are regular and monodisperse. This allows a greater percentage of the total grain population to receive optimum surface fogging. Unfortunately, emulsions with monodisperse grain populations exhibit only narrow exposure latitudes.

It is common practice to blend emulsions of differing mean equivalent circular diameter (ECD) grains to increase exposure latitude. Using monodisperse emulsions having a mean coefficient of variation (COV) of less than 20% (taught in other terms by Illingsworth U.S. Pat. No. 3,501,305), it is burdensome to separately precipitate, fog and blend the many different emulsions required to achieve an exposure latitude of 3.0 log E.

Another approach to increasing the exposure latitude of direct-positive emulsions is to blend surface fogged silver halide grains that have been fogged to different degrees. The problem is that the range of surface fogging differences to achieve an exposure latitude of at least 3.0 log E results in an emulsion blend lacking satisfactory levels of sensitometric stability.

Taber et al U.S. Pat. No. 3,647,463 illustrates how the art has struggled to work within the limitations of fogged direct-positive emulsions to construct radiographic duplicating films of the required exposure latitude. Taber et al discloses the following structures:

| Gelatin Layer |
|---|
| Light-Sensitive Silver Halide (13)<br>Light-Insensitive 0.1-1.5 Density Layer (12)<br>Light-Sensitive Silver Halide (11)<br>Support<br>FIG. 1 |

| Gelatin Layer |
|---|
| Light-Sensitive AgX (16)<br>Light-Insensitive 0.1–1.5 Density Layer (15)<br>Light-Sensitive Layer + Absorbing Dye (14)<br>Support<br>FIG. 2 |

| Gelatin Overlayer |
|---|
| Light-Sensitive Layer (18)<br>Support<br>Light-Sensitive Layer + Absorbing Dye (17)<br>Gelatin Overlayer<br>FIG. 3 |

In Example 4 of Taber et al an exposure latitude of 2.5 at an average contrast of −1.14 and a maximum density of 3.31 is achieved using the FIG. 2 construction, in which a total of three different emulsion layers (14, 15 and 16) are coated, with emulsion layer 14 containing a blend of three different emulsions and two absorbing dyes, layer 15 containing a single unsensitized emulsion, and layer 16 containing a blend of two different emulsions. The remaining arrangements reported in the Examples, although almost equally complex, all fail to satisfy acceptable performance requirements for radiographic duplicating film.

Inoue et al U.S. Pat. No. 5,298,381 discloses a photographic element containing a direct-positive emulsion layer having surface fogged grains and an overcoat layer containing a microcrystalline dye employed for the purpose of imparting room light handling capability to the element.

Microcrystalline dyes are known to reduce crossover in dual coated (e.g., Duplitized™) radiographic taking films when coated between the emulsion layer units and the transparent film support, as taught by Dickerson et al U.S. Pat. Nos. 4,803,150, 4,900,652 and 4,997,750.

Further illustrations of microcrystalline dyes contained in photographic elements are provided by Factor et al U.S. Pat. No. 4,855,221, Diehl et al U.S. Pat. Nos. 4,877,721 and 4,940,654, Anderson et al U.S. Pat. No. 4,988,611, Usami et al U.S. Pat. No. 5,238,799, Texter U.S. Pat. No. 5,274,109 and Karino EPO 0 456 163.

SUMMARY OF THE INVENTION

The disadvantages of requiring multiple emulsions and/or sensitizations along with multiple emulsion layers to achieve a satisfactory radiographic duplicating film are apparent from the teachings of Taber et al. Taber et al contains an additional disadvantage that it fails to mention. Although the Example 4 structure approaches radiographic duplicating film capabilities in a gross sense, there is still the problem that the photographic characteristic curve produced does not exhibit a locally invariant contrast. In fact, to achieve the kind of smooth characteristic curve that is typically produced by a taking film over an exposure latitude of 3.0 log E Taber et al would have had to blend several additional emulsions.

It is an object of the present invention to provide a radiographic duplicating film that is capable of reproducing the image of a taking radiographic film while requiring only a single monodisperse direct-positive silver halide emulsion. Blending of surface fogged silver halide grains is not required, nor is it necessary to subject different portions of the grain population to different fogging conditions. In other words, a simple, efficient and conveniently constructed duplicating film is contemplated.

In one aspect this invention is directed to a radiographic duplicating film for duplicating a silver image in a radiographic taking film, the radiographic duplicating film being comprised of a transparent film support, a direct-positive imaging unit exhibiting an average contrast of from −0.8 to −1.2 over an exposure range measured from a density of 0.5 to a density of 2.5, and a protective overcoat free of microcrystalline dye particles, wherein the direct-positive imaging unit consists of a single, direct-positive emulsion layer and contains (a) surface fogged silver halide grains for recording exposure to electromagnetic radiation that has in part passed through the radiographic taking film and has been in part absorbed by the silver image within the radiographic taking film (1) having a mean grain equivalent circular diameter in the range of from 0.20 to 0.70 μm, (2) exhibiting a coefficient of variation of grain equivalent circular diameter of less than 20 percent, (3) coated at a silver coverage of from 2.0 to 3.5 g/m$^2$, and (4) containing at least 50 mole percent bromide and less than 3 mole percent iodide, based on silver, any remaining halide being chloride, and (b) microcrystalline particles (1) consisting essentially of a dye capable of absorbing a portion of the electromagnetic radiation received from the radiographic taking film and capable of being decolorized during photographic processing, (2) having a mean equivalent circular diameter of less than 1 μm and (3) coated at a coverage of from 10 to 50 percent by weight, based on the weight of silver forming the surface fogged silver halide grains.

DESCRIPTION OF PREFERRED EMBODIMENTS

A radiographic duplicating film satisfying the requirements of the invention can be constructed as follows:

| |
|---|
| Protective Overcoat |
| Direct-positive Imaging Unit<br>Transparent Film Support |

Since radiographic images are commonly read by a radiologist using a diffuse white light source (e.g., a light box), the duplicating film is constructed using a transparent film as a support. Radiologists prefer relatively cold image tone, therefore it is common practice to incorporate a blue dye or pigment in the transparent film support. Any conventional transparent film support known to be useful in radiography or photography can be employed, illustrated broadly by *Research Disclosure*, Vol. 308, December 1989, Item 308119, Section XVII, and *Research Disclosure*, Vol. 184, August 1979, Section XII. *Research Disclosure* is published by Kenneth Mason Publications, Ltd., Dudley House, 12 North St., Emsworth, Hampshire P010 7DQ, England. Preferred transparent film supports are formed by polyesters of dibasic carboxylic acids, such poly(ethylene terephthalate). Preferred dyes for providing a permanent blue tint to the support are anthraquinone dyes, such as those disclosed by Hunt U.S. Pat. No. 3,488,195, Hibino et al U.S. Pat. No. 3,849,139, Arai et al U.S. Pat. Nos. 3,918,976 and 3,933,502, Okuyama et al U.S. Pat. No. 3,948,664 and U.K. Patents 1,250,983 and 1,372,668.

Coated on the support is a direct-positive imaging unit. The imaging unit exhibits an average contrast of from −0.8 to −1.2, preferably from −0.9 to −1.1, over an exposure range measured from a density of 0.5 to a density of 2.5. Since the exposure latitude must of necessity extend to a minimum density (i.e., a density of zero), it is apparent that the duplicating film has a working exposure latitude of at least 2.5. Preferably, the duplicating film has an exposure latitude of at least 3.0. With this exposure latitude the duplicating film is capable of reproducing maximum imaging densities of at least 3.0.

In the density range of from 0.5 to 2.5 it is preferred that the contrasts at any two exposures, hereinafter referred to as the "point gammas", differ by less than 40 percent, most preferably less than 20 percent. The measurement of point gammas is illustrated by Kuwashima et al U.S. Pat. No. 4,792,518 and Dickerson et al U.S. Pat. No. 5,108,881, the disclosures of which are here incorporated by reference. Stated qualitatively, the direct-positive imaging unit is substantially free of local variances in contrast, such as those that occur when the overall exposure latitude is realized by blending or utilizing as taught by Taber et al, cited above, less than 6 monodisperse emulsions each having a COV of less than 20 percent.

The direct-positive imaging unit consists of a single, direct-positive emulsion layer. The emulsion layer contains surface fogged silver halide grains for recording exposure to electromagnetic radiation that has in part passed through a radiographic taking film and has been in part absorbed by the silver image within the radiographic taking film. Since silver is known to exhibit a very nearly uniform density in the spectral region ranging from the near ultraviolet (300 to 400 nm), through the visible (400 to 700 nm), and within the near infrared (700 to 1500 nm), it is apparent that the surface fogged silver halide grains can rely entirely upon their native sensitivity for exposure in the near ultraviolet or can be spectrally sensitized to record exposures in the visible and/or near infrared portions of the spectrum.

The surface fogged grains contain at least 50 mole percent bromide and less than 3 mole percent iodide, any remaining halide being chloride. Preferably the surface fogged grains contain at least 65 mole percent bromide and less than 1 mole percent iodide, any remaining halide being chloride. It is preferred to limit or exclude iodide to increase the rate at which the duplicating film can be photographically processed. Thus, based solely on processing criteria, the surface fogged grains are preferably substantially free of iodide. Thus, in one convenient form, the surface fogged grains consist essentially of silver bromide as the sole silver halide. While it is generally accepted that silver chloride is capable of more rapid photographic processing than silver bromide, no detectable modification of photographic performance has been observed at chloride concentrations ranging from 0 to 30 mole percent, based on total silver. Although not required, it is generally most convenient to prepare the surface fogged grains with substantially uniform halide distributions.

The grains require no ingredient in addition to silver halide. However, to facilitate bleaching of the fog at the surface of the grains, which is accomplished by photogenerated holes, it is preferred to incorporate within the grains one or more dopants capable of providing electron trapping sites. In this way, when absorption of a photon on imagewise exposure produces a conduction band electron (i.e., a photoelectron) and a hole, the presence of internal trapping sites for the photoelectron (which plays no useful role in imaging) minimizes the risk of the corresponding hole being annihilated by recombination with the photoelectron before bleaching of surface fog can occur. The use of various Group VIII platinum metals (Ru, Rh, Pd, Os, Ir and Pt), particularly iridium and rhodium, as internal dopants is disclosed by B. H. Carroll, "Iridium Sensitization: A Literature Review", *Photographic Science and Engineering*, Vol. 24, No. 6, November/December 1980, pp. 265–267; Spence et al U.S. Pat. No. 3,687,676; Gilman et al U.S. Pat. No. 3,761,267; Hine U.S. Pat. No. 4,814,263; Mitsuhashi U.S. Pat. No. 5,206,132; and Graindoureze et al EPO 0 477 436. Janusonis et al U.S. Pat. No. 4,835,093 discloses the incorporation of rhenium as an internal sensitizer for fogged direct-positive grains. When a dopant is incorporated in the grains to trap photoelectrons, the grains can conveniently take a core-shell structure-that is, the outermost portion of the grain can be free of dopant, as taught by Berriman U.S. Pat. No. 3,367,778. Dopant concentrations as high as $10^{-2}$ mole per Ag mole are taught, but preferred dopant concentrations are in the range of from about $10^{-6}$ to $10^{-4}$ mole per silver mole.

Taken together, all of the surface fogged grains in the direct-positive emulsion layer exhibit a grain size (ECD) coefficient of variation of less than 20 percent. This is quite different from employing blends of direct-positive emulsions selected for different mean grain ECD's to provide exposure latitude. In the latter instance, even if the individual emulsions chosen for blending are monodisperse (i.e., contain a grain size COV of less than 20%), the COV of the blended emulsion must of necessity be much larger. Illingsworth U.S. Pat. No. 3,501,305, the disclosure of which is here incorporated by reference, discloses performance advantages for direct-positive emulsions with monodisperse surface fogged grains. Illingsworth defines monodispersity in terms of requiring 95 percent of the grains to be within ±40 percent of the mean grain diameter. Subsequently the art has shifted to measuring dispersity in terms of COV. A mathematical explanation of COV is contained in Mitsuhashi U.S. Pat. No. 5,206,132, the disclosure of which is here incorporated by reference. Although grain size monodispersity is an advantage, extremely narrow grain size distributions are not required and are not compatible with obtaining broad exposure latitude. Thus, a preferred grain size COV range is from greater than ten percent to less than twenty percent.

The surface fogged grains can take any convenient conventional shape. The grains can be regular or irregular. That is, the grains can contain one or more twin planes or screw dislocations. Tabular grains and multiply twinned grains are the most commonly employed types of irregular grains. Regular grains are taught to be preferred grains for forming fogged direct-positive emulsions by Illingsworth U.S. Pat. No. 3,501,306 and are preferred. Regular grains typically take the form of regular octahedral, cubo-octahedral or cubic grains, with the latter being preferred. Regular grains offer the advantage of being more readily precipitated with limited dispersities and containing fewer non-performing grains-that is, grains that do not play a useful role in image formation.

The mean ECD of the surface fogged grains is in the range of from 0.20 to 0.70 μm. In photography, larger grain sizes are employed for obtaining higher photographic speeds while smaller grain sizes are employed to minimize image noise (granularity). Since duplicating films are exposed using a controlled light source, there is no reason to incur unnecessary image noise to increase speed. Therefore, in duplicating films it is usually preferred to employ fine grain emulsions. Unfortunately, mean grain diameters of less than about 0.30 μm provide increasingly warm image tone. As previously noted, radiologists prefer cold image tones to the extent of employing films with blue tinted supports. It is specifically contemplated, although not required, to incorporate addenda in the emulsion layer to provide colder image tones. Hershey et al U.S. Pat. Nos. 5,292,627 and 5,314,790, here incorporated by reference, disclose polythiaalkyl-substituted azoles to be capable of producing colder image tones. It is generally preferred to employ surface fogged grains having mean ECD's in the range of from 0.3 to 0.5 μm.

The grains are surface fogged. The management of surface fog is largely determinative of photographic speed. The grains can be surface fogged by employing conventional reduction and/or gold chemical sensitizing agents and overfinishing the grains. In the preparation of negative-working surface latent image forming emulsions, chemical sensitizers are added, followed by heating for a limited time, referred to as finishing. Finishing is limited to maintain fog below a minimal level acceptable for negative-working emulsions. In preparing the surface fogged grains of direct-positive emulsions, finishing is simply extended, driving the emulsions into fog. Illingsworth U.S. Pat. No. 3,501,307, here incorporated by reference, teaches to increase the speed of direct-positive emulsions containing surface fogged grains by limiting the amount of surface fog. The highest speed direct-positive emulsions containing surface fogged grains are those fogged by employing a combination of reduction and gold sensitizers. Reduction and gold sensitizers are disclosed by Illingsworth U.S. Pat. Nos. 3,501,305, '306 and '307 and by *Research Disclosure*, Item 308,119, cited above, Section III. Chemical sensitization, sub-section A. Preferred reduction sensitizers include stannous chloride, thiourea dioxide, polyamines and amineboranes. More recent teachings of reduction sensitizers are provided by Yamashita et al U.S. Pat. No. 5,254,456 and EPO 0 407 576 and 0 552 650. Recent interest in gold sensitizers has been directed toward gold(I) sensitizers. More recent gold sensitizers are illustrated by Mucke et al U.S. Pat. No. 4,906,558, Miyoshi et al U.S. Pat. No. 4,914,016, Mifune U.S. Pat. No. 4,914,017, Aida et al U.S. Pat. No. 4,962,015, Hasebe U.S. Pat. No. 5,001,042, Janji et al U.S. Pat. No. 5,024,932, Deaton U.S. Pat. Nos. 5,049,484 and 5,049,485, Ikenoue et al U.S. Pat. No. 5,096,804, EPO 0 439 069, EPO 0 446 899, EPO 0454 069 and EPO 0 564 910. Recent illustrations of applying sensitizers to prepare surface fogged grains are provided by Kitshita et al U.S. Pat. No. 4,847,190, Arai U.S. Pat. No. 5,043,259 and Mitsuhashi U.S. Pat. No. 5,206,132, the disclosure of which are here incorporated by reference.

The surface fogged grains can rely on their native absorption of near ultraviolet (300 to 400 nm) and short blue (400 to 430 nm) light for photon capture. For exposures in the visible or longer wavelength ranges it is preferred to adsorb one or a combination of spectral sensitizing dyes to the surfaces of the surface fogged grains to facilitate photon capture. Useful spectral sensitizing dyes are summarized in *Research Disclosure*, Item 308,119, cited above, Section IV. Spectral sensitization and desensitization, the disclosure of which is here incorporated by reference. The same spectral sensitizing dyes used for surface latent image forming silver halide grains can be employed, if desired. These dyes simply absorb light and transfer energy to the grain to create the photogenerated electron and hole pairs required for imaging.

For direct-positive imaging with surface fogged grains the preferred spectral sensitizing dyes are those that desensitize surface latent image forming silver halide grains. These spectral sensitizing dyes contain one or more nuclei that trap photoelectrons and thereby increase the speed of the surface fogged grains not only by photon capture and transfer of energy to the grains, but also by capturing photogenerated electrons, thereby minimizing the annihilation of photogenerated holes by hole-electron recombination. The dye nuclei that are particularly effective in trapping electrons are set out in *Research Disclosure*, Item 308,119, Section IV, A. Sensitizing Dyes, sub-section G. Compounds containing one these nuclei, but lacking a dye chromophore can also be used as electron trapping agents. Exemplary useful electron-trapping spectral sensitizing dyes for fogged direct-positive emulsions are summarized in sub-section J.

Blended with the surface fogged grains in the emulsion layer are microcrystalline particles consisting essentially of a dye capable of absorbing a portion of the electromagnetic radiation used to expose the grains and capable of being decolorized during photographic processing. The mean ECD of the microcrystalline dye particles is preferably less than 1 μm and most preferably equal to or less than the mean ECD of the grains. Larger microcrystalline particles are readily prepared, with photographically useful microcrystalline dye particles of up 10 μm being taught for use in photographic applications. However, to facilitate the same rapid processing typically employed in the use of radiographic taking films, it is preferred to limit the maximum ECD of the dye particles. The minimum ECD of the microcrystalline particles is limited only by preparation convenience. Mean ECD's of down to about 0.01 μm have been reported.

The proportion of the microcrystalline dye particles in the emulsion layer is from 10 to 50 percent by weight, based on the weight of silver. Preferably the microcrystalline dye particles account for from 10 to 25 percent by weight of the emulsion layer, based on the weight of silver.

The advantage of introducing the dye into the emulsion layer in a particulate form is that, in this insoluble form, the dye is immobile. It cannot wander to the surface of the silver halide grains, thereby risking displacement of sensitizing dye from the grain surface or desensitization. It also cannot wander out of the emulsion layer into the protective overcoat overlying the emulsion layer. As illustrated in the Examples below, when a microcrystalline particle dye is converted to a soluble form before incorporation into the emulsion layer, a performance penalty is incurred. It is, of course, possible to immobilize soluble dyes by adsorption to host particles or mordanting, but this, of course, adds still another complexity to the emulsion layer. Further,,it is difficult to decolorize fully mordanted dyes within the limited time available in radiographic processing.

A specifically preferred class of dyes for forming microcrystalline particles are those disclosed by Lemahieu et al U.S. Pat. No. 4,092,168, Diehl et al WO 88/04794, Factor et al U.S. Pat. No. 4,855,221, Anderson et al U.S. Pat. No. 4,988,611 and Schmidt et al U.S. Pat. No. 5,104,777. These dyes satisfy the formula:

$$[D-(A)_y]-X_n \qquad (I)$$

wherein

D is a chromophoric light-absorbing compound, which may or may not comprise an aromatic ring if y is not zero and which comprises an aromatic ring if y is zero;

A is an aromatic ring bonded directly or indirectly to D;

X is a substituent, either on A or an aromatic ring portion of D, with an ionizable proton;

y is 0 to 4; and n is 1 to 7.

Diehl et al U.S. Pat. No. 4,940,654 discloses preferred dyes satisfying formula (I) in which D has a pKa of about 4 to 11 in a 50:50 mixture (volume basis) of ethanol and water, and the dye has a log partition coefficient of from about 0 to 6 when the compound is in its unionized form.

Preferred microcrystalline particle dyes are oxonol methine dyes containing two pyrazolin-5-one nuclei. Diehl et al U.S. Pat. No. 4,877,721 discloses microcrystalline dye particles useful in the practice of this invention formed by oxonol methine dyes containing two (2-pyrazolin-5-one) nuclei joined through a methine linkage, the nuclei being substituted with acyl groups in the 3 and 3' positions; aryl groups in the 1 and 1' positions; and bearing from 4 to 6 acidic substituents, each of which is capable of forming a monovalent anion.

The microcrystalline dyes can be physically ground to the required mean particle size. Texter U.S. Pat. No. 5,274,109 discloses the microprecipitated dispersions of dyes satisfying the formula:

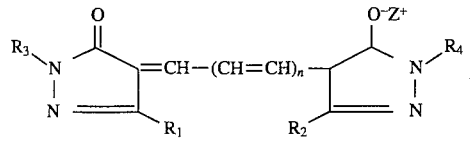

wherein n is zero, 1 or 2;

$R_1$, $R_2$, $R_3$ and $R_4$ are the same or different substituted or unsubstituted alkyl or aryl groups, one or more of $R_1$, $R_2$, $R_3$ and $R_4$ contains carboxy substituent —C(O)O$^{31}$ $Z^+$, wherein $Z^+$ is a statistical mixture of hydrogen ($H^+$) and alkali or tetraalkylammonium cations ($M^+$) such that $Z^+=xH^++(1-x)M^+$, where x is a decimal ranging from about 0.33 to about 0.95.

Structural variations on the microcrystalline particle forming dyes disclosed above are illustrated by Usagawa et al U.S. Pat. No. 5,208,137 and EPO 0 434 413, Adachi U.S. Pat. No. 5,213,957, Usami (et al) U.S. Pat. No. 5,238,798 and '799, Inagaki et al U.S. Pat. No. 5,075,205 and EPO 0 385 461, Otp et al U.S. Pat. No. 5,098,818, McManus et al U.S. Pat. No. 5,098,820, Fujita et al EPO 423 693, Usui EPO 0 423 742, Jimbo et al EPO 0 460 550, Diehl et al EPO 0 524 593 and '594 and Ohno EPO 0 552 646.

The following are illustrative preferred microcrystalline particle dyes:

D-1 1-(4'-carboxyphenyl)-4-(4'-dimethylaminobenzylidene)-3-ethoxycarbonyl-2-pyrazolin-5-one D-2 1-(4'-carboxyphenyl)-4-(4'-dimethylaminobenzylidene)-3-methyl-2-pyrazolin-5-one D-3 bis[1-(4-carboxyphenyl)-3-methyl-2-pyrazolin-5-one-4]monomethine oxonol D-4 bis(3-ethyoxycarbonyl-1-p-sulfophenyl-2-pyrazolin-5-one-4)trimethinoxonol trisodium salt D-5 bis(3-acetyl-1-p-sulfophenyl-2-pyrazolin-5 -one)trimethine oxonol trisodium salt D-6 bis[1-(4-carboxyphenyl)-3-ethyl-2-pyrazolin-5 -one-4] trimethine oxonol D-7 bis[3-acetyl-1-(2,5-disulfophenyl)-2-pyrazolin-5-one-4]pentamethine oxonol, pentasodium salt D-8 bis[3-methyl-1-(4-sulfophenyl)-2-pyrazolin-5 -one-4] meso-methylpentamethine oxonol, trisodium salt D-9 bis[3-methyl-1-(2,5-disulfophenyl)-2-pyrazolin-5-one-4]pentamethine oxonol, pentasodium salt D-10 bis[3-carboxy-1-(3-sulfopropyl)-2-pyrazolin-5 -one-4] pentamethine oxonol, pentasodium salt D-11 bis[3-carboxy-1-(2,5-disulfophenyl)-2-pyrazolin-5-one-4]pentamethine oxonol, heptasodium salt D-12 1-(4-carboxyphenyl)-4-[(7-diethylaminobenzo-2 -pyrone-3)methine]-3-ethoxycarbonyl-2-pyrazolin-5-one Microcrystalline dye particles satisfying formula (I) have been demonstrated to be decolorizable under radiographic processing conditions, as illustrated by Dickerson et al U.S. Pat. Nos. 4,803,150, 4,900,652, 4,997,750, 5,041,364, 5,259,016.

Although microcrystalline dye particles have found extensive use in photographic and radiographic elements, principally in filter and antihalation layers, the use to which the dyes are placed in the practice of this invention is novel and unexpected. It has been observed that the microcrystalline dyes are capable of reducing the average contrast of fogged directed-positive emulsions from the high levels of from −2.0 to −5.0 that they characteristically exhibit when prepared for optimum efficiency and stability to an average contrast of approximately −1.0 preferred for a radiographic duplicating film. Further, the point gammas of the emulsion layer remains relatively invariant.

In addition to the surface fogged grains and the microcrystalline dye particles, the emulsion layer contains a conventional photographic vehicle, including a peptizer for the grains and a binder, each of which may be a hydrophilic colloid, such as gelatin or a gelatin derivative. The emulsion layer can also include vehicle extenders, such as latex particles. Any of the vehicles and vehicle extenders disclosed by *Research Disclosure*, Item 308,119, cited above, Section IX. can be employed. The emulsion layer also includes a conventional hardener or combination of hardeners, as disclosed by Item 308,119, Section X.

Overlying the emulsion layer is a conventional protective layer. The protective layer is typically a hydrophilic colloid layer containing one or a combination of the vehicles and vehicle extenders described in Section IX and one or a combination of hardeners described in Section X, each section being cited above. In addition, one or both of the emulsion land protective layers, but most commonly the protective layer alone, typically contains one or more antistatic agents (see Item 308,119, cited above, Section XIII for a summary of conventional antistatic agents) and matting agents (see Item 308,119, cited above, Section XVI for summary of conventional matting agents). In addition, the emulsion and/or protective layer and, typically both, can contain coating aids (see Item 308,119, cited above, Section XV for a summary of conventional coating aids) and plasticizers and lubricants (see Item 308,119, cited above, Section XII for summary of conventional plasticizers and lubricants). The protective layer is free of microcrystalline dye particles, since, as shown in the Examples below locating these dyes at this location fails to satisfy performance requirements.

To eliminate curl a backing or pelloid layer can be coated on the surface of the film support opposite the emulsion and protective layers. The backing layer can, if desired, contain one or more conventional antihalation dyes capable of being decolorized during processing. The same microcrystalline dye particles incorporated in the emulsion layer can also be incorporated in the backing layer to perform the antihalation function. Alternatively, one or more conventional soluble antihalation dyes can be incorporated in the backing layer, since there is no possibility of the soluble dye reaching the emulsion or protective layers prior to processing. A summary of conventional absorbing materials suitable for use as antihalation dyes is provided by *Research Disclosure*, Item 308,119, cited above, Section VIII, sub-section C.

It is preferred that the duplicating films of the invention be constructed to permit processing in the same types of rapid access processors used to process radiographic taking films, thereby avoiding the necessity of a separate processor for duplicating films. The capability of rapid access processing (that is, processing within 90 seconds or less) places limitations on the amount of water the hydrophilic colloid layers, can take up during processing, since all of this water must be quickly removed during drying. With conventional hardening of the hydrophilic layers rapid processing can be readily realized when the hydrophilic colloid present on any one side of the support is limited to less than 6 g/m$^2$. If the backing layer does not require processing solution penetration (e.g., it contains no processing solution decolorizable dye), it can be more highly hardened than the emulsion and protective layers. In this instance, the degree of hardening rather than limiting the amount of hydrophilic colloid can be relied upon to limit processing solution ingestion to a level compatible with rapid processing.

Since rapid access processors employed commercially vary in their specific processing cycles and selections of processing solutions, the duplicating elements of the invention capable of undergoing rapid access processing are identified as those that are capable of emerging dry to the touch when processed in 90 seconds or less according to the following reference conditions:

| | |
|---|---|
| development | 24 seconds at 35° C., |
| fixing | 20 seconds at 35° C., |
| washing | 10 seconds at 35° C., and |
| drying | 20 seconds at 65° C. |

where the remaining time is taken up by transport between processing steps, development step employing the following developer:

| | |
|---|---|
| Hydroquinone | 22.0 g |
| 1-Phenyl-3-pyrazolidone | 1.35 g |
| KOH | 8.3 g |
| $NaKCO_3$ | 5.5 g |
| $Na_2CO_3$ | 4.7 g |
| $K_2SO_3$ | 60.1 g |
| 5-Methylbenzotriazole | 0.06 g |
| Potassium acetate | 12.7 g |
| Potassium metaborate | 1.3 g |
| Glutaraldehyde bis-bisulfite | 13.7 g |
| Diethylene glycol | 10.0 g |
| 5-Nitroindazole | 0.127 g |
| Pentetic acid, sodium salt | 2.13 g |

Water to 1 liter, pH 10.3 at 27° C., and the fixing step employs the following fixing compositions:

| | |
|---|---|
| Ammonium thiosulfate | 260.0 g |
| Sodium bisulfite | 180.0 g |
| Boric acid | 25.0 g |
| Acetic acid | 10.0 g |
| Aluminum sulfate | 8.0 g |
| Water to 1 liter, pH 3.9 to 4.5. | |

By proper balancing of hydrophilic colloid coverages and hardening it is possible to construct duplicating films according to the present invention that are capable of satisfying 90 to 30 second processing cycles.

EXAMPLES

The invention can be further appreciated by consideration of the following Examples.

Example 1

A 0.35 μgm mean ECD iridium doped, monodisperse (COV <20%) silver bromide emulsion was precipitated in the following manner:

| | | |
|---|---|---|
| Solution A: | 2.0N NaBr | 5.10 liters |
| Solution B: | 2.0N $AgNO_3$ | 5.00 liters |
| Solution C: | KBr | 0.385 gram |
| | $(HOCH_2CH_2SCH_2)_2$ | 1.0 grams |
| | gelatin | 317 grams |
| | water | 5.50 liters |
| Solution D: | $K_2IrCl_6$ | 0.0483 gram |
| | water | 0.020 liters |

Solution C was placed in a reaction vessel equipped with standard Ag/AgCl sensing and reference electrodes and was adjusted to a pAg 7.2 at 67° C. Emulsion precipitation was initiated by the double-jet addition of Solutions A and B at 0.05 L/min while maintaining the pAg at 7.2. The initial, nucleation flow was maintained for 2.5 minutes, at which time the flow was accelerated to and maintained at 0.10 L/min. After 0.30 L of Solution B had been added, Solution D was added in 0.77 minute. After 0.35 L of Solution B had been added, the pAg was lowered to and maintained at 6.5 until the addition of Solution B was completed.

The emulsion was washed by the ultrafiltration method described in *Research Disclosure*, Vol. 131, March 1975, Item 13122.

The emulsion was fogged by the addition of 0.10 micromole of dimethylamineborane, hereafter referred to as C-1, and 0.67 micromole of bis(1,4,5 -trimethyl-1,2,4-triazolium-3-thiolato)gold(I) tetrafluoroborate, hereafter referred to as C-2, followed by digestion at 70° C. This surface fogged direct-positive is hereinafter referred to as Emulsion E1.

In Control Coating 1 (CC-1) Emulsion E1 was blended with additional gelatin and coated on one side of a blue-tinted poly(ethylene terephthalate) film support. The gelatin coating coverage was between 2.25–2.65 g/m$^2$, and the silver coating coverage was between 2.5–3.0 g/m$^2$. Over the emulsion layer was coated a gelatin overcoat (OC) at a coverage of 0.98 g/m$^2$. On the opposite side of the film support, a pelloid layer containing an antihalation dye and a pelloid overcoat layer were coated at gelatin coverages of 2.9 and 1.4 g/m$^2$, respectively. All of the hydrophilic colloid layers were hardened with bis(vinylsulfonylmethyl)ether at 2.5% of the gelatin weight.

Second and third coatings, Control Coatings 2 and 3, were identically prepared, except that microcrystalline dye D-3 was dissolved at a pH of 7.4 and introduced in the overcoat (CC-2) or in the emulsion layer (CC-3).

Fourth and fifth coatings, Control Coating 4 and Example 1, were identically prepared, except that the microcrystalline dye D-3 was added in particulate form (mean ECD=0.08 μm). In CC-4 microcrystalline dye particles were added to the overcoat, while in Example 1 microcrystalline dye particles were added to the emulsion layer.

The five coatings were then identically exposed through a graduated density test object using a General Electric BLB™ lamp, which provided a source of near ultraviolet light (principally in the wavelength range of from 350 to 390 nm). The exposed coatings were then processed in a Kodak RP X-Omar™processor in 90 seconds in the following manner:

| | |
|---|---|
| development | 24 seconds at 40° C., |
| fixing | 20 seconds at 40° C., |
| washing | 10 seconds at 40° C., and |
| drying | 20 seconds at 65° C. |

where the remaining time is taken up by transport between processing steps, the development step employing the following developer:

| | |
|---|---|
| Hydroquinone | 22.0 g |
| 1-Phenyl-3-pyrazolidone | 1.35 g |
| KOH | 8.3 g |
| $NaKCO_3$ | 5.5 g |
| $Na_2CO_3$ | 4.7 g |
| $K_2SO_3$ | 60.1 g |
| 5-Methylbenzotriazole | 0.06 g |
| Potassium acetate | 12.7 g |
| Potassium metaborate | 1.3 g |
| Glutaraldehyde bis-bisulfite | 13.7 g |
| Diethylene glycol | 10.0 g |
| 5-Nitroindazole | 0.127 g |
| Pentetic acid, sodium salt | 2.13 g |

Water to 1 liter, pH 10.3 at 27° C., and the fixing step employing the following fixing compositions:

| | |
|---|---|
| Ammonium thiosulfate | 260.0 g |
| Sodium bisulfite | 180.0 g |
| Boric acid | 25.0 g |
| Acetic acid | 10.0 g |
| Aluminum sulfate | 8.0 g |
| Water to 1 liter, pH 3.9 to 4.5. | |

A density versus log exposure (log E) characteristic curve was then plotted for each of the five coatings. From the characteristic curves the overall average contrast (OAC) between an image density of 0.5 and 2.5 was determined. The results are summarized in Table I below:

TABLE I

| Coating | Dye | OAC |
|---|---|---|
| CC-1 | No Dye | −2.80 |
| CC-2 | OC (dissolved) | −1.48 |
| CC-3 | E1 (dissolved) | −1.31 |
| CC-4 | OC (microcrystalline particles) | −1.84 |
| Ex. 1 | E1 (microcrystalline particles) | −0.96 |

Referring to Table I it is apparent that the surface fogged direct-positive emulsion E1 exhibited an overall average contrast (OAC) that was too high to be used for duplicating a radiographic taking film image without increasing its recorded image contrast. The addition of dye D-3 in a dissolved form, either to the overcoat or the emulsion layer significantly reduced overall average contrast, but not to the degree needed for duplicating film use. When dye D-3 was used in the form of microcrystalline particles in the overcoat, it was even less effective than when used in dissolved form. However, when dye D-3 was used in the form of microcrystalline particles and placed in the emulsion layer, it produced an overall average contrast of near unity, as required to duplicating film use. The results were neither predicted nor expected.

Example 2

This example illustrates the simplicity of the invention in achieving overall average contrasts suitable for duplicating film as compared to the conventional approach of separately finishing emulsion aliquots to different degrees and then recombining them.

The emulsion precipitated in Example 1 was surface fogged to four different degrees in order to achieve four components of differing sensitivities, E2 through E5. A blend of equal parts of these components was prepared and coated in the presence of 0.150–0.225 mmole per silver mole of an organic electron acceptor, 6-chloro-4-nitro-1,2,3-benzotriazole (OEA). In Table II below are listed the levels of fogging agents, C-1 and C-2, in micromoles per silver mole (μM/AgM) used to produce components of different sensitivities such that their blend would produce a lower overall average contrast. The sensitivity difference between successive components averaged 0.55 LogE. Four comparison films were constructed using only one emulsion and no microcrystalline dye while a fifth film was constructed using a blend of the other four emulsions, but again not using microcrystalline dye.

Coating, exposure and processing were undertaken as described in Example 1.

TABLE II

| Film Emulsion | C-1 (μM/AgM) | C-2 (μM/AgM) | Dye D-3 (μM/AgM) | OAC |
|---|---|---|---|---|
| E1 (Ex. 1) | 0.10 | 0.67 | 0.72 | −0.96 |
| E2 | 0.0645 | 0.387 | 0 | −2.79 |
| E3 | 0.145 | 0.894 | 0 | −3.00 |
| E4 | 0.403 | 2.42 | 0 | −3.02 |
| E5 | 1.49 | 8.94 | 0 | −3.08 |
| E2 + E3 + E4 + E5 | | | 0 | −1.38 |

From Table II it is apparent that even with a blend of four differently finished emulsions the overall average contrast was still higher than required by a duplicating film. At this point investigation of blending surface fogged direct-positive emulsions to produce a satisfactory duplicating film was discontinued. It was estimated that a total of 6 or 7 emulsion finishes would be required to obtain a duplicating film with an overall average contrast of approximately −1.0. On the other hand, with such wide variances in finishing being required, the probabilities of obtaining a resulting emulsion with low variances of point gammas and the stability required for practical use was considered too low to merit further investigation.

Example 3

This example is provided to demonstrate that adjustment of microcrystalline dye particle concentrations can be employed to adjust overall average contrast.

Emulsion E6 was precipitated similarly as emulsion E1 in Example 1 and was surface fogged by a 70° C. digestion at pH 10.5 and pAg 8.5 followed by the addition of 1.0 micromole of C-2 at pH 6.0 and pAg 8.5 and a second digestion at 75° C. OEA was added to E6 at 0.45 mmole per silver mole.

Coating, exposure and processing were undertaken as described for Example 1, except that the level of dye in the emulsion E6 was varied as shown in Table III. Dye concentrations are reported in millimole per square meter (mM/m2).

TABLE III

| Dye D-3 | OAC |
|---|---|
| 0 | −2.41 |
| 0.579 | −1.15 |
| 0.676 | −1.04 |
| 0.772 | −0.96 |

From Table III it is apparent that only small amounts of the microcrystalline particle dye are required to adjust overall average contrast within the useful ranges for duplicating film.

Example 4

This example illustrates the compatibility of microcrystalline dye particles in the emulsion layer with spectral sensitizing dyes adsorbed to the grain surfaces.

Example 1 was repeated, but with these differences: 2-[2-(1,2-Diphenyl-3-indolyl)vinyl]-1,3,3-trimethyl-3H-pyrrolo[2,3-b]pyridinium perchlorate, SS-1, an electron trapping spectral sensitizing dye exhibiting a maximum density of 498 nm in methanol plus acid was adsorbed to the grain surfaces, and the grain surfaces were fogged by the addition of 0.892 μmole/moleAg of C-1 and 0.535 μmole/moleAg of C-2. Two coatings were prepared. In one coating no microcrystalline particle dye was added. In another coating microcrystalline particle dye D-1 (ECD=0.18 μm) was present in a concentration of 1.6 mmole/$m^2$. Exposure was undertaken through a graduated test object using a tungsten light source, chosen for its low ultraviolet, principally visible light output.

The results are summarized in Table IV.

TABLE IV

| Dyes Present | OAC |
|---|---|
| SS-1 only | −4.89 |
| SS-1 + D-1 | −1.17 |

The duplicating film with the spectral sensitizing and the microcrystalline particle dyes both present in the emulsion layer performed satisfactorily, demonstrating their compatibility.

Example 5

This example is provided to demonstrate the feasibility of employing in the emulsion layer a mixture of microcrystalline particle dyes with absorption peaks in the near ultraviolet and visible, respectively, to produce a duplicating film exhibiting useful overall average contrasts when exposed in either the visible or in the near ultraviolet.

Example 1 was repeated, but with these differences: 1,3-Diethyl-1'-methyl-2'-phenylimidazolo[4,5-b] -quinoxolino-3'-indolocarbocyanine iodide, SS-2, an electron trapping green spectral sensitizing dye was adsorbed to the surface fogged grain surfaces, and OEA was added at 0.225 mmole/moleAg. In one coating only the spectral sensitizing dye SS-2 was present in the emulsion layer, no microcrystalline dye particles being present. In a second coating only the microcrystalline particle dye D-12 was present. In a third coating both the microcrystalline particle dyes D-3 and D-12 were present. In each occurrence the concentration of the microcrystalline dye D-3 was 0.60 mmole/$m^2$ and the concentration of dye D-12 was 0.75 mmole/$m^2$. Two samples of each coating were prepared to allow each coating to be exposed separately to the tungsten light source and the near ultraviolet light source described above.

Overall average contrasts are reported in Table V.

TABLE V

| Coating | OAC (visible exp.) | OAC (near UV exp.) |
|---|---|---|
| SS-2 only | −3.66 | −2.87 |
| SS-2 + D-3 | −3.42 | −1.02 |
| SS-2 + D-3 + D-12 | −1.44 | −0.71 |

From Table V it is apparent that the coatings lacking any microcrystalline particle dye exhibited overall average contrasts too high to be usefully employed as duplicating films, whether exposed in the visible or near ultraviolet region of the spectrum. Microcrystalline particle dye D-3, which absorbs principally in the near ultraviolet portion of the spectrum, was effective to reduce overall average contrast when exposure to near ultraviolet light was undertaken, but had only a limited impact on overall average contrast when relied upon as the sole microcrystalline particle dye for light capture in the visible. When microcrystalline particle dyes D-3 and D-12, having peak absorptions in the near infrared and visible, respectively, were both present in the emulsion layer overall average contrast was markedly reduced. Although not actually undertaken, it is apparent that only routine adjustment of the coating concentrations are required to produce coatings that satisfy duplicating film overall average contrast values contemplated by this invention when exposures in either the visible or near ultraviolet portions of the spectrum are employed.

The invention has been described in detail with particular reference to preferred embodiments thereof, but it will be understood that variations and modifications can be effected within the spirit and scope of the invention.

What is claimed is:

1. A radiographic duplicating film for duplicating a silver image in a radiographic taking film, the radiographic duplicating film being comprised of a transparent film support, a direct-positive imaging unit exhibiting an average contrast of from −0.8 to −1.2 over an exposure range measured from a density of 0.5 to a density of 2.5, and a protective overcoat free of microcrystaline dye particles, wherein the direct-positive imaging unit consists of a single, direct-positive emulsion layer and contains (a) surface fogged silver halide grains for recording exposure to electromagnetic radiation that has in part passed through the radiographic taking film and has been in part absorbed by the silver image within the radiographic taking film (1) having a mean grain equivalent circular diameter in the range of from 0.20 to 0.70 μm, (2) exhibiting a coefficient of variation of grain equivalent circular diameter of less than 20 percent, (3) coated at a silver coverage of from 2.0 to 3.5 g/$m^2$, and (4) containing at least 50 mole percent bromide and less than 3 mole percent iodide, based on silver, any remaining halide being chloride, and (b) microcrystalline particles (1) consisting essentially of a dye capable of absorbing a portion of the electromagnetic radiation received from the radiographic taking film and capable of being decolorized during photographic processing, (2) having a mean equivalent circular diameter of less than 1 μm and (3) coated at a coverage of from 10 to 50 percent by weight, based on the weight of silver forming the surface fogged silver halide grains.

2. A radiographic duplicating film according to claim 1 wherein the transparent support is blue tinted.

3. A radiographic duplicating film according to claim 1 wherein the direct-positive imaging unit is capable of producing a maximum density of at least 3.0.

4. A radiographic duplicating film according to claim 1 wherein the surface fogged silver halide grains exhibit a mean equivalent circular diameter of 0.3 to 0.5 μm.

5. A radiographic duplicating film according to claim 1 wherein the surface fogged silver halide grains contain greater than 65 mole percent bromide and less than 1 mole percent iodide.

6. A radiographic duplicating film according to claim 1 wherein the surface fogged silver halide grains are surface fogged cubic grains.

7. A radiographic duplicating film according to claim 1 wherein the microcrystalline particles have a mean equivalent circular diameter equal to or less than the mean equivalent circular diameter of the surface fogged silver halide grains.

8. A radiographic duplicating film according to claim 1 wherein the microcrystalline particles are coated at a coverage of from 10 to 25 percent by weight, based on the weight of silver.

9. A radiographic duplicating film according to claim 1 wherein the microcrystalline particles consist essentially of a dye which satisfies the formula:

$$[D—(A)_y]—X_n$$

wherein

D is a chromophoric light-absorbing compound, which may or may not comprise an aromatic ring if y is not zero and which comprises an aromatic ring if y is zero;

A is an aromatic ring bonded directly or indirectly to D;

X is a substituent, either on A or an aromatic ring portion of D, with an ionizable proton;

y is 0 to 4; and n is 1 to 7.

10. A radiographic duplicating film according to claim 9 wherein the microcrystalline dye particles consist essentially of an oxonol methine dye containing two pyrazolin-5-one nuclei.

11. A radiographic duplicating film for duplicating a silver image in a radiographic taking film comprised of a blue tinted transparent film support, a direct-positive imaging unit exhibiting an average contrast of from −0.8 to −1.2 over an exposure range measured from a density of 0.5 to a density of 2.5 and capable of producing a maximum density of at least 3.0, and a protective overcoat, wherein the direct-positive imaging unit consists of a single, direct-positive emulsion layer and contains (a) surface fogged silver halide grains for recording exposure to electromagnetic radiation that has in part passed through the radiographic taking film and been in part absorbed by the silver image within the radiographic taking film (1) having a mean grain equivalent circular diameter in the range of from 0.30 to 0.50 μm, (2) exhibiting a coefficient of variation of grain equivalent circular diameter of less than 20 percent, (3) coated at a silver coverage of from 2.2 to 3.0 g/m$^2$, and (4) containing at least 65 mole percent bromide and less than 1 mole percent iodide, based on silver, any remaining halide being chloride, and (b) microcrystalline particles (1) consisting essentially of a dye capable of absorbing a portion of the electromagnetic radiation received from the radiographic taking film and capable of being decolorized during photographic processing, (2) having a mean equivalent circular diameter equal to or less than the equivalent circular diameter of the fogged silver halide grains and (3) coated at a coverage of from 10 to 25 percent by weight, based on the weight of silver forming the surface fogged silver halide grains.

12. A radiographic duplicating film according to claim 1 or 11 wherein at least the protective overcoat and the direct-positive emulsion layer each contain a hydrophilic colloid vehicle and the hydrophilic colloid present on any one side of the support is limited to less than 6 g/m$^2$ and is sufficiently forehardened to allow the radiographic duplicating film to be developed, fixed, washed and emerge dry to the touch in a 90 second process cycle consisting of

| | |
|---|---|
| development | 24 seconds at 35° C., |
| fixing | 20 seconds at 35° C., |
| washing | 10 seconds at 35° C., and |
| drying | 20 seconds at 65° C. |

where the remaining time is taken up by transport between processing steps, development step employing the following developer:

| | |
|---|---|
| Hydroquinone | 22.0 g |
| 1-Phenyl-3-pyrazolidone | 1.35 g |
| KOH | 8.3 g |
| $NaKCO_3$ | 5.5 g |
| $Na_2CO_3$ | 4.7 g |
| $K_2SO_3$ | 60.1 g |
| 5-Methylbenzotriazole | 0.06 g |
| Potassium acetate | 12.7 g |
| Potassium metaborate | 1.3 g |
| Glutaraldehyde bis-bisulfite | 13.7 g |
| Diethylene glycol | 10.0 g |
| 5-Nitroindazole | 0.127 g |
| Pentetic acid, sodium salt | 2.13 g |

Water to 1 liter, pH 10.3 at 27° C., and the fixing step employing the following fixing compositions:

| | |
|---|---|
| Ammonium thiosulfate | 260.0 g |
| Sodium bisulfite | 180.0 g |
| Boric acid | 25.0 g |
| Acetic acid | 10.0 g |
| Aluminum sulfate | 8.0 g |
| Water to 1 liter, pH 3.9 to 4.5. | |

13. A radiographic duplicating film according to claim 12 wherein the radiographic duplicating film when processed in said process cycle exhibits an average contrast in the range of from −0.9 to −1.1 over the image density range of from 0.5 to 2.5.

* * * * *